US010743686B2

(12) United States Patent
Mansoor et al.

(10) Patent No.: US 10,743,686 B2
(45) Date of Patent: Aug. 18, 2020

(54) FLAT SHEET PROVIDING FITTED MATTRESS ENGAGEMENT

(71) Applicants: Nasreen Mansoor, Solana Beach, CA (US); Joseph Perrone, Solana Beach, CA (US)

(72) Inventors: Nasreen Mansoor, Solana Beach, CA (US); Joseph Perrone, Solana Beach, CA (US)

( * ) Notice: Subject to any disclaimer, the term of this patent is extended or adjusted under 35 U.S.C. 154(b) by 0 days.

(21) Appl. No.: 16/461,948

(22) PCT Filed: May 16, 2019

(86) PCT No.: PCT/US2019/032708
§ 371 (c)(1),
(2) Date: May 17, 2019

(87) PCT Pub. No.: WO2019/222528
PCT Pub. Date: Nov. 21, 2019

(65) Prior Publication Data

US 2020/0046150 A1 Feb. 13, 2020

Related U.S. Application Data

(60) Provisional application No. 62/672,438, filed on May 16, 2018.

(51) Int. Cl.

| | |
|---|---|
| ***A47G 9/02*** | (2006.01) |
| ***A47C 21/02*** | (2006.01) |
| ***A47G 9/04*** | (2006.01) |

(52) U.S. Cl.
CPC ..... *A47G 9/0246* (2013.01); *A47C 21/022* (2013.01); *A47G 9/04* (2013.01)

(58) Field of Classification Search
CPC ..... A47G 9/0246; A47G 9/04; A47G 9/0238; A47G 9/0292; A47C 21/022
See application file for complete search history.

(56) References Cited

U.S. PATENT DOCUMENTS

| | | | | | |
|---|---|---|---|---|---|
| 1,646,792 | A * | 10/1927 | Moore | A47D 15/02 | 5/485 |
| 1,841,410 | A * | 1/1932 | Karr | A47C 21/022 | 5/500 |
| 2,630,588 | A * | 3/1953 | Levin | A47C 31/105 | 5/496 |
| 5,375,280 | A * | 12/1994 | O'Sullivan | A47C 21/00 | 5/495 |
| 8,707,482 | B1 * | 4/2014 | Ramthun | A47G 9/0246 | 5/496 |
| 2012/0317723 | A1 * | 12/2012 | Liversage | A47G 9/0246 | 5/497 |

(Continued)

*Primary Examiner* — Robert G Santos
*Assistant Examiner* — Alison N Labarge
(74) *Attorney, Agent, or Firm* — Donn K. Harms

(57) ABSTRACT

A flat bottom sheet is provided which is adapted for engagement to an underlying mattress. A plurality of biasing bands are configured to provide a biased engagement of four corners of the bottom sheet to four corners of the mattress and concurrently biasly hold side portions taught against the sides of the mattress. A top sheet may be included which is engaged to the bottom sheet and allows for concurrent engagement of both a top and bottom sheet to a mattress to which they are sized to engage.

19 Claims, 6 Drawing Sheets

(56) References Cited

U.S. PATENT DOCUMENTS

| | | | | |
|---|---|---|---|---|
| 2014/0075672 | A1* | 3/2014 | Marcik | A47G 9/0246 5/494 |
| 2015/0074906 | A1* | 3/2015 | Hiatt | A47C 31/105 5/484 |
| 2017/0056265 | A1* | 3/2017 | Duck | A47G 9/0246 |

* cited by examiner

FLAT SHEET PROVIDING FITTED MATTRESS ENGAGEMENT

This application claims priority to U.S. Provisional Application Ser. No. 62/672,438, filed on May 16, 2018, which is incorporated herein in its entirety by this reference thereto.

FIELD OF THE INVENTION

This invention relates in general to bedding employed to cover mattresses. More particularly, it relates to a sheet having a flat configuration when stored but which is configured to engage the mattress corners in a biased fitted engagement once operatively positioned to cover the top and sides of a mattress.

BACKGROUND OF THE INVENTION

Bedding conventionally sold and used by consumers typically includes multiple items to maintain the sleeping occupants of the bed warm and comfortable. Such bedding, widely sold in the U.S. and many foreign countries, for example includes sheets, pillowcases, shams, comforters and other bedding items.

An important component for comfortable bedding are sheets which cover the mattress and the occupant and such are generally sold and used in sets which typically include a bottom sheet which engages over the mattress upon which the bed occupants lay, and a top sheet which covers the occupants and provides a separating layer between the blankets and other bedding.

Sheet sets, as noted, are conventionally sold in a set or pairs which include a flat top sheet and a fitted bottom sheet which is adapted in a configuration to securely engage over and around the underlying mattress. While a flat sheet may also be employed to cover the mattress, fitted sheets are preferred to such flat sheets because they may be easily and generally securely engaged around and over mattress corners to yield a secure engagement which will not easily disengage like a flat sheet.

However, fitted sheets while providing for a quick and secure covering of the underlying mattress, have some shortcomings when disengaged from the mattress such as when folded and stored with a mating flat sheet. Because the corners of fitted sheets are sewn to form a pocket which includes two side edges which cover the sides of the mattress and an elastic surrounded portion which is adapted to engage under the corner of the mattress, such fitted sheets are not easily folded after laundering. Further, when covering a mattress with such a fitted sheet, it is hard for the user to determine how to properly position the fitted sheet on top of a mattress for proper engagement.

This is because mattresses conventionally have a length dimension which exceeds the width dimension and the fitted sheet is sewn to accommodate this configuration. However, the user generally must guess how to position the fitted sheet on the mattress to engage the sheet corners properly and this is a 50/50 proposition since the fitted sheet dimensions are not discernable when folded or even when positioned atop the mattress for engagement.

An additional issue in more recent years with fitted sheets has arisen due to the varying depth or thicknesses of different brands and types of mattresses. Because fitted sheets are sewn with a fixed pocket at each corner, this pocket formation also fixes the width of the sheet portions which fit on and around the side surface of the mattress. When a fitted sheet encounters a mattress which has a thickness or depth wider than a mattress depth for which the pockets of the fitted sheet have been formed, the fixed sewn corner pockets will either not fit correctly, or they will fit by over stretching. Such over stretching renders the sheet highly prone to disengage.

The fitted sheet herein disclosed and described, provides a flat configuration which is easily folded and stored after laundering. The disclosed sheet also provides corners which will accommodate a much wider range of mattress depths while concurrently providing an easily engaged highly secure biased engagement at each corner.

The forgoing examples of related art, with regard to fitted sheets adapted for mattress engagement, and limitation related therewith, are intended to be illustrative and not exclusive, and they do not imply any limitations on the invention described and claimed herein. Various limitations of the related art will become apparent to those skilled in the art upon a reading and understanding of the specification below and the accompanying drawings.

OBJECTS OF THE INVENTION

It is an object of this invention to provide a substantially planar bed sheet or combination thereof, which while configured for secure biased engagement with mattress corners, will fold easily and store flat.

It is another object of this invention to provide a bed sheet which is adapted to engage with corners of a mattress for secure long term positioning, but which employs a corner engagement system which is not affected by the thickness of the mattress to which it engages.

These and other objects, features, and advantages of the present flat sheet for fitted mattress engagement invention, as well as the advantages thereof over existing prior art, which will become apparent from the description to follow, are accomplished by the improvements described in this specification. Such are additionally described in the following detailed description which fully discloses the invention, but should not be considered as placing limitations thereon.

SUMMARY OF THE INVENTION

In accordance with the purposes of the present invention, as embodied and broadly described herein, the present invention provides a bed sheet configured which is adapted for snug fitted engagement over the top surface of a mattress, and has corner securements adapted to engage corners of a mattress of virtually any thickness without over stretching the material forming the bed sheet. The sheet, as shown and described herein, is easily folded to a flat or planar folded configuration for storage after laundering and before engagement to a mattress.

In all favored modes of the device herein, the disclosed bed sheet is configured to allow a user, during engagement of the bed sheet to an underlying mattress, to easily discern a proper orientation of the sheet on top of the mattress. Such is important prior to securing the corners of the bed sheet to respective biased engagements with each mattress corner.

The disclosed bed sheet device herein, solves the shortcomings of conventional pocketed fitted sheets, which have limited volume in the formed pockets for mattress corner engagement through a provided corner engagement system that adapts to virtually any mattress thickness. Further, the disclosed bed sheet allows for proper pre-positioning upon the top surface area of the mattress and easy discerning of the correct sheet orientation. This visible means for orientation is provided by a preliminary viewing of mattress corners, and their respective alignment with the engaged corner biasing bands affixed adjacent the four corners of the sheet herein.

Additionally, the corners of the device herein, are not pre-sewn to pockets which fix the dimensions of perimeter portions of the sheet which cover the mattress sides to a fixed width. Instead, the disclosed bed sheet herein can be configured to extend beyond the corner biasing bands a distance to accommodate a mattress of virtually any depth. This is because the biasing bands are always aligned to engage over the mattress corners but do not impede tucking the side portions around and under the mattress, as is the case with sewn and pocketed fitted sheets.

Still further, the elastic biasing bands once positioned to engage around the lower surface at the corner portion of the mattress, form a secure engagement which equals or exceeds those provided by sheets with sewn pockets used in conventional fitted sheets. This improved engagement thereby holds the corners fitted and secure on a mattress of any depth, for the duration it is engaged thereto.

With respect to the above description, before explaining at least one preferred embodiment of the herein disclosed flat sheet device with biased corner engagement invention in detail, it is to be understood that the invention is not limited in its application to the details of construction and to the arrangement of the components in the following description or illustrated in the drawings. The sheet device herein described and disclosed in the various modes and combinations is also capable of other embodiments and of being practiced and carried out in various ways which will be obvious to those skilled in the art upon reading this disclosure. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other corner biased fitted flat sheet devices and for carrying out the several purposes of the present disclosed device. It is important, therefore, that the claims be regarded as including such equivalent construction and methodology insofar as they do not depart from the spirit and scope of the present invention.

Further the above stated and additional objectives of this invention will be brought out in the following part of the specification wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only nor exclusive examples of embodiments and/or features of the disclosed fitted flat sheet device. It is intended that the embodiments and figures disclosed herein are to be considered illustrative of the invention herein, rather than limiting in any fashion.

In the drawings:

FIG. 1 depicts a top plan view of the sheet herein showing the flat rectangular sheet body having four biasing bands operatively engaged to the sheet body in positions adapted to biasly secure the sheet corners in a fitted configuration to an underlying mattress.

FIG. 2 depicts the sheet of figure one placed upon an underlying mattress where the biasing bands have been operatively positioned thereon, to place opposing ends of each band, adjacent the intersection of the side mattress surface with the top mattress surface, and where the user can ascertain the proper length and width orientation relative to the mattress which is easily viewed and discerned prior to a fitted engagement there over.

FIG. 3, while not to be interpreted as limiting in any fashion, shows dimensions for the sheet herein for a typical queen-sized mattress.

DETAILED DESCRIPTION OF THE INVENTION

Figure 1:
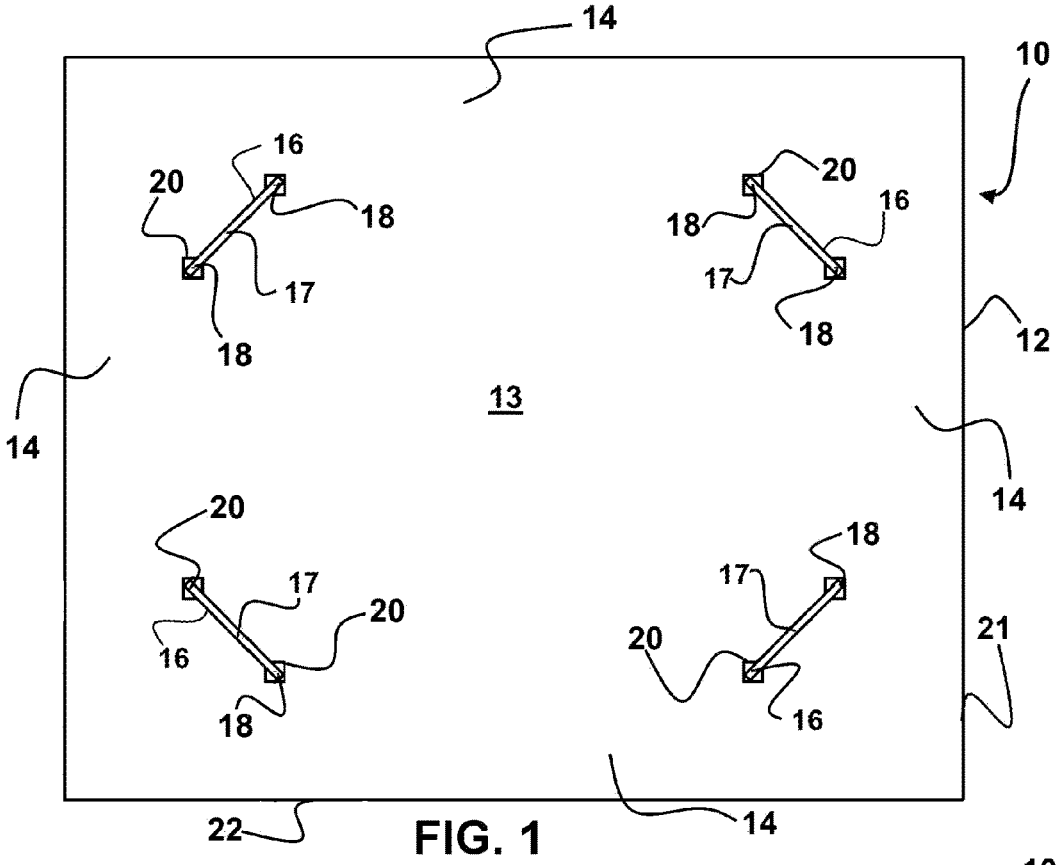

In this description, any directional prepositions if employed, such as up, upwardly, down, downwardly, front, back, top, upper, bottom, lower, left, right and other such terms refer to the device or depictions as they may be oriented are for convenience only in describing such as it appears in the drawings. Such terms of direction and location are not intended to be limiting in ay fashion, or to imply that the device or method herein has to be used or positioned with graphics in any particular orientation.

Now referring to drawings in FIGS. 1-9, wherein similar components are identified by like reference numerals, there is seen in FIG. 1 the sheet device 10 formed as a bottom sheet which is adapted to engage with a mattress. The bottom sheet is shown as having a body 12 which is formed of conventional woven or knitted sheet materials such as cotton or other natural or synthetic fabrics.

Figure 4:
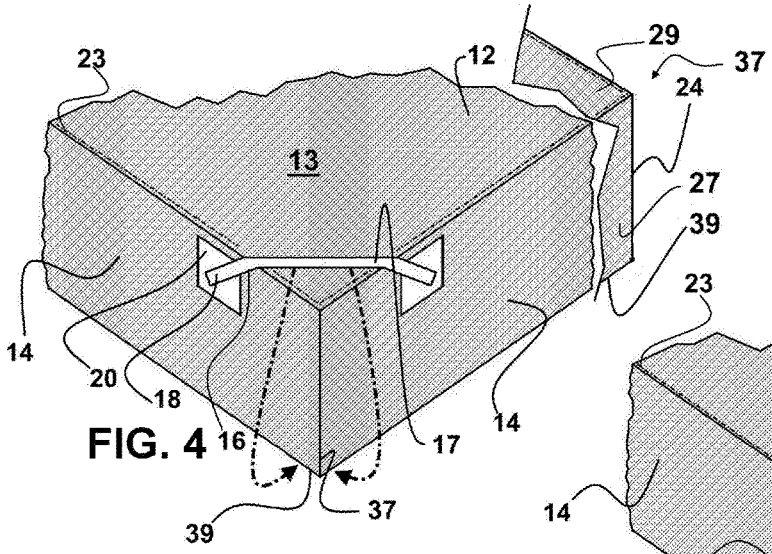
FIG. 4 shows a corner biasing band positioned as in FIG. 2 running diagonally across the top surface of the mattress and shows perimeter side portions of the sheet engaged around the sides of the mattress.

The body 12 forming the bottom sheet of the device 10 in all modes, is configured substantially in a rectangular shape and sized for engagement to the underlying mattress. Depending on the dimensions of the mattress to which the body 12 is adapted for engagement, the body 12 will vary in overall length and width dimensions within the perimeter edge 21 thereof. In this manner, in all preferred modes of the device 10 herein, the body 12 when engaged to an underlying mattress, will have edge portions 14 sized to cover the sidewall of the mattress 24 and tuck under the bottom of the mattress around the four sides 27 forming the sidewall of the mattress 24 (FIG. 4).

Also shown in FIG. 1, are four biasing bands 16 which are secured at opposing ends 18 to the sheet body 12 in positions substantially adjacent to the intersection of the perimeter edge 23 shown in imaginary line which defines a central area 13 of the body 12. By adjacent is meant within ¼ to 3 inches of the perimeter edge 23.

These biasing bands 16 in all modes herein, are preferably formed of elastic material which when elongated impart a bias to return the biasing band 16 to its un-stretched length. The elastic material will as such impart a bias upon both ends 18 of each biasing band 16 at their respective connections of both ends 18 to the body 12 of the sheet device 10. This biasing force pulls both ends 18 toward each other as well as imparting a contracting force to a central portion 17 of each biasing band 16 located between both ends 18.

Figure 5:
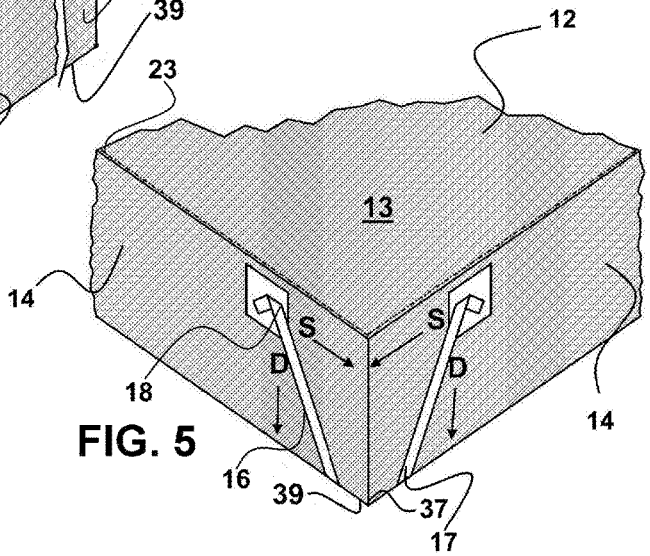
FIG. 5 shows the corner biasing band of FIG. 4 having been moved to an engaged position engaged around the rear surface of the mattress and elongated whereby the elastic force imparts a biased fitted engagement of the corner with the underlying mattress.

The positioning of each respective biasing band 16 in a respective encircled engagement around one corner of the intended mattress, thus provides for a biased engagement of each corner as shown in FIG. 5. The result being that the fabric forming the sides and corner area of the body 12 wrap around and are held in a biased engagement against the mattress side surfaces and around the bottom surface of each corner 37 (FIGS. 4-5) of the mattress 24.

Figure 6:
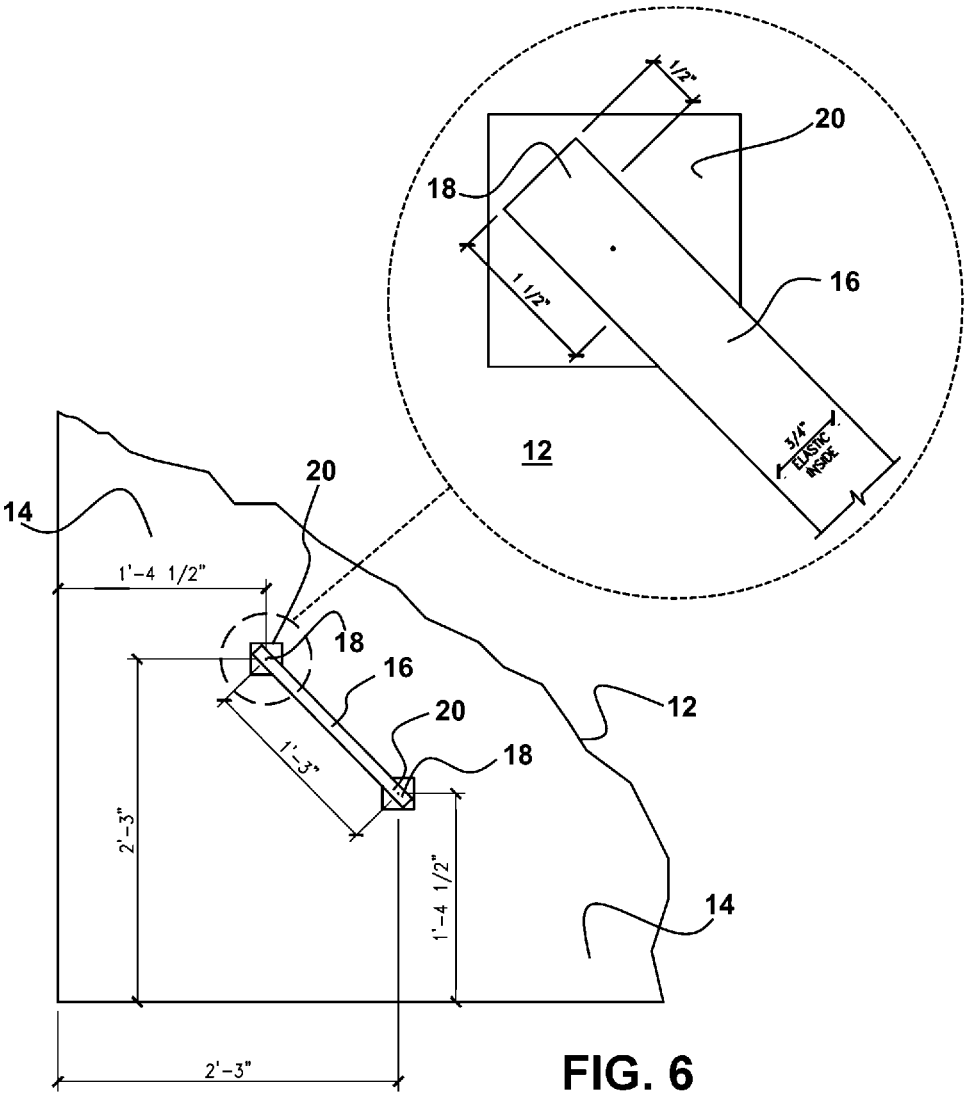
FIG. 6 shows a typical engagement for a sheet herein of a conventional queen-sized mattress where each of the four biasing bands run along a line diagonal to the two side edges of the sheet which run perpendicular to each other. Also shown is the preferred fabric reinforcement of the sheet at the connections of both ends of the biasing band thereto.

Additionally shown in FIG. 1, and for example in an enlarged depiction in FIG. 6, while not required it is preferred that the connection at both ends 18 of each biased band 16 to the body 12, have a reinforcement section 20 attached to the body 12 of the sheet device 10. The ends 18 and the reinforcement sections 20 may be attached to the body 12 by sewing or by adhesive or by other means for attachment which is conventionally employed.

In all modes of the device 10 whether the body 12 is sized for a twin bed or another size such as a king bed, each of the four biasing bands 16 are positioned in registered engagements upon the body 12 which locates the ends 18 and reinforcement sections 20 to respective positions adjacent a side surface of the underlying mattress 24 (FIG. 5) where that side surface intersects a top surface 29 (FIG. 5) in the well known configuration of a conventional mattress 24.

So positioned, each biasing band 16 runs diagonally relative to the perimeter edge 21 of the body 12 defining the area of the body 12 of the bottom sheet, and to the perimeter edge 23 shown in dotted line defining the central area 13 of the body 12, which is substantially equal in length, width, and area, of the top surface 29 of the underlying mattress 24. The biasing bands 16 running in this perpendicular orientation, also run diagonally to the line of the four perpendicular edge portions 14 of the body 12 which intersect adjacent each corner of the body 12.

As noted herein, this diagonal positioning of the biasing bands 16 is particularly preferred. This is because in addition to providing a targeting component for the body 12, once a biasing band 16 at any corner is stretched and engaged around an underside of the underlying mattress 24, it provides for both of a downward "D" biasing force as well as sideways "S" biasing force shown for example in FIG. 5. This dual biasing force is imparted to the central area 13 of the sheet body 12 to keep it taught on the mattress 24. Further, the dual biasing force also imparts force to maintain the four side edge portions 14 of the body 12, surrounding the central area 13, taught and tucked, when engaged at a mattress corner 37.

Figure 2:
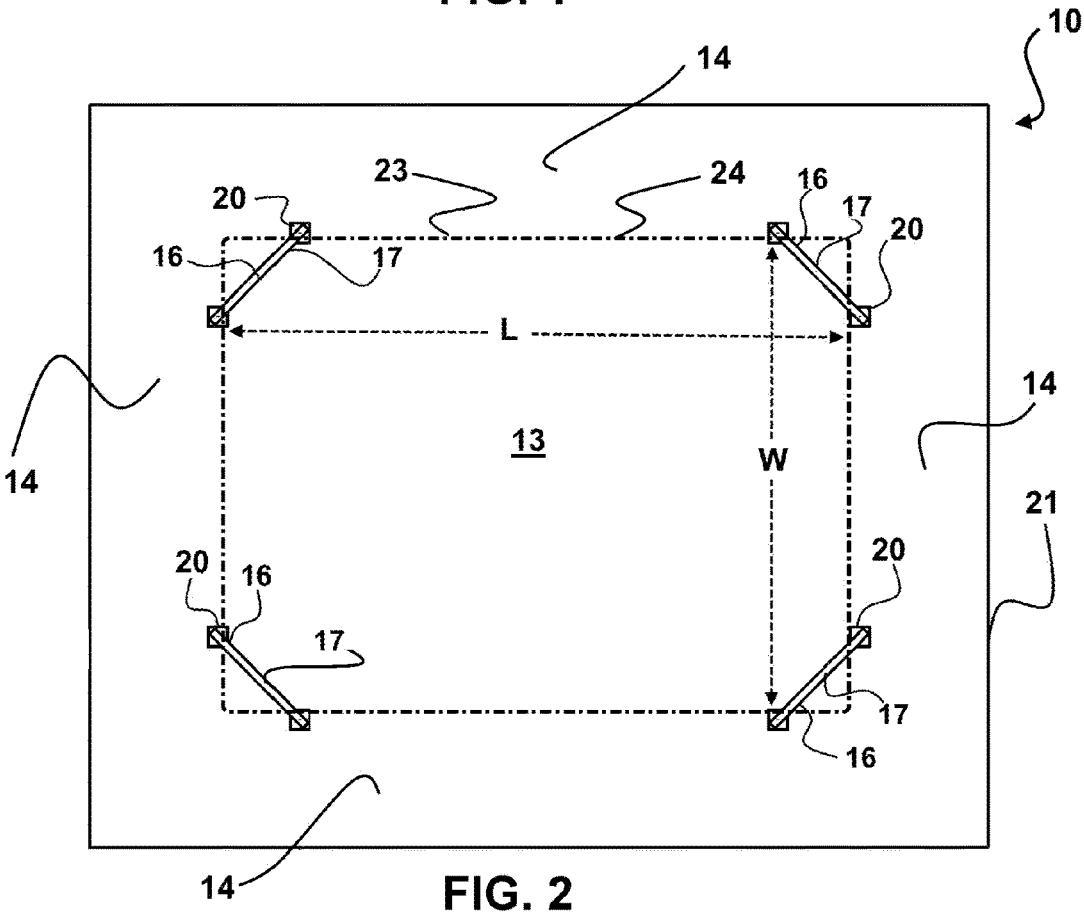

As additionally noted herein, a positioning of a biasing band 16 atop and crossing each corner of the top surface 29 of the intended mattress 24 to which the body 12 engages as in FIG. 2, provides a visual targeting component for the body 12 position relative to the underlying top surface 29 of the mattress 24. This allows the user to determine a proper sheet orientation relative to the mattress 24 and its perimeter edge 23.

In FIG. 2 is shown this orientation of visual targeting allowing the user to visually determine a proper sheet body 12 orientation of the central area 13 atop and coaxially aligned with the top surface 29 of the underlying mattress 24. In use, the body 12 is positioned to place the central area 13 and its perimeter 23 aligned with the mattress top surface 29 and with the corners of the top surface 29 of the underlying mattress 24 underneath each of the four biasing bands 16. With the central area 13 and the top surface 29 aligned and coaxial, each of the four biasing bands 16 is stretched and moved such that they surround the mattress 24 corners 37 on the bottom 39 surface of the mattress 24.

The perimeter edge 23 shown in imaginary dotted line and surrounding the central area 13 of the body 12 of the bottom sheet, has a length "L" and width "W." This central area 13 has such a length L and width W which is substantially equal to that of the top surface of the underlying mattress 24. By substantially equal is meant preferably equal with a maximum variance of plus or minus ten percent. Adjusting the size of the central area 13 and registered positioning of the bands 16 to overlap the corners thereof, the body 12 of the sheet can be adapted to fit any size underlying mattress 24.

Each sheet body 12 herein, may thus be adapted to engage any mattress 24, by forming the central area 13 of the sheet body 12, with the length "L" and width "W" of a central area 13, sized to substantially match the area of a top surface 29 of the intended mattress 24 and locate the perimeter of the top surface 29 of the mattress, substantially aligned with the perimeter edge 23 of the central area 13.

The four edge portions 14 extending from the central area 13 are sized with a width configured to be least two inches longer than the side surface of the intended mattress 24. Currently, the width of the edge portions 14 from the edge 23 surrounding the central area 13 to the perimeter edge 21 of the body 12, is substantially 12-20 inches, which provides a sufficient portion for tucking under the bottom surface 39 of the mattress 24.

As can be discerned, forming the body 12 in this fashion with the dimensions of the central area 13 substantially equal to the dimensions of the top surface 29 of the intended mattress 24, renders the body 12 of the bottom sheet easy to target for proper positioning on the mattress 24. This is done, as noted, by the simple positioning of four diagonal biasing bands 16 such that they cross the four corners of the rectangular cental area 13 and this automatically positions each of the two opposing ends 18 of the bands 16, adjacent one of the two sides of the central area 13.

As a further explanation, as can be seen in FIG. 2, during this targeting positioning of the central area 13 of the body 12 of the sheet device 10, substantially aligned with a top surface 29 of a mattress 24, the underlying mattress 24 can be seen supporting a central area 13 of the body 12. Also shown are corners of the perimeter edge 23 surrounding central area 13 aligned with the top surface 29 of the mattress 24, projecting substantially equally past the axis of each diagonally positioned biasing band 16. This visual targeting component using the positioning of the four biasing bands 16 and central area 13 as noted, insures proper sheet body 12 orientation before moving forward with tucking the four edge portions 14, and biasly engaging the biasing bands 16 as in FIGS. 5-6.

Figure 3:
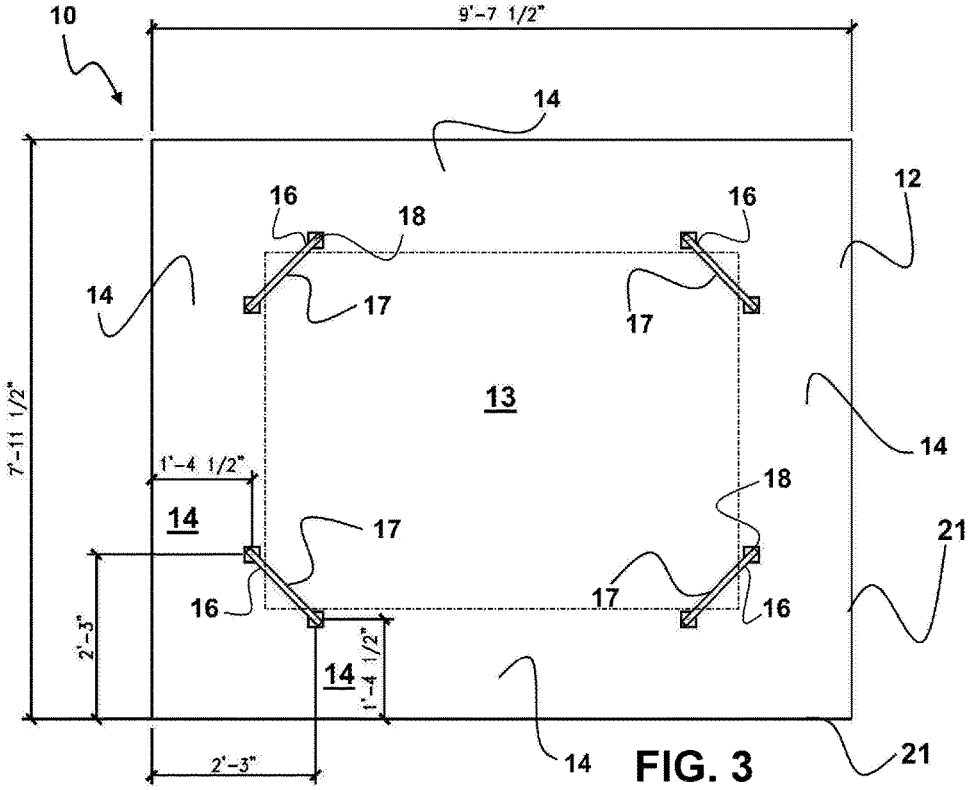

FIG. 3 depicts a typical sheet device 10 where the body 12 has been cut and hemmed to form a rectangular size, having a central area 13 adapted to be substantially equal to and aligned with the area of a top surface of a queen-sized bed. In this and configurations for other sized mattresses 24, the biasing bands 16 are diagonally positioned and attached at opposing ends 18 to the body 12, such that they extend across a top portion of the intended mattress 24 the body 12 is adapted to engage. As noted, such diagonal positioning and spacing of the biasing bands 16 relative to the central area 13, thus form the visual targeting component for determining proper orientation shown in FIG. 2, for any sized mattress 24.

Of course the depicted measurements will change depending on the perimeter size of the top surface 29 of the intended mattress 24 over which the body 12 of the device 10 is adapted to engage in a fitted engagement. The depth of the mattress 24 between its top and bottom surface 39, to which the device 10 engages can change, and such is well known to those skilled in the art. The biasing bands 16 are formed of elastic material sufficient in elasticity to stretch to accommodate such and if needed during manufacture. Further they may be adjusted in length, to accommodate a mattress 24 of any length, width, and depth.

FIG. 4 shows a typical corner biasing band 16 with opposing ends 18 engaged to the body 12 of the sheet and having reinforcing sections 20 included at the end engagements. As can be seen, the perimeter edge portions 14 have been tucked around the sidewall of the mattress 24 shown as sides 27 and under the bottom surface 39 of the underlying mattress 24. The width of the mattress sidewall formed by all for sides 27 determines the depth of the mattress 24 or space between the top surface 29 and the bottom surface 39 thereof.

At this juncture, as shown by the dotted line arrows, the biasing band 16 is to be elongated and secured under the corner 37 of the mattress 24 with a central area of the biasing band 16 in contact with the bottom surface 39 of the mattress 24 as shown in FIG. 5. This is done once the body 12 of the device 10 has been targeted and positioned for the biased fitted engagement at the corners 37 in the manner noted where the central area 13 is aligned with the area of the top surface 29 of the mattress 24 defined by the intersection of the sidewall or sides 27 therearound.

As can be seen in FIG. 5 the body 12 of the sheet is placed in the biased fitted engagement where the two intersecting perimeter edge portions 14 are tucked around the mattress sides 27 and under the bottom 39 of the mattress 24. So positioned at all four corners 37 of the mattress 24, each biasing band 16 because of its diagonal positioning on the body 12, imparts a biasing force both down "D" toward the bottom 39 of the mattress 24 and sideways "S" in a direction toward the underlying corner 37 edge of the mattress 24. The dual biasing force in two directions at each mattress 24 corner 37 thus provides an extremely secure fitted engagement of the body 12 of the sheet to the mattress 24 at the corners 37 which will not easily disengage without the user pulling the biasing band 16 from its encircling contact of the bottom surface 39 at the corner edge of the mattress 24.

Depicted in FIG. 6, is a typical connection of each of both ends 18 of the four biasing bands 16 to the body 12 of the sheet device 10. As can be seen, the biasing bands 16 so engaged at both ends 18 run in a diagonal line toward both of the two linear edges of the body 12 of the sheet which run perpendicular to each other. Also shown is the preferred fabric reinforcement sections 20 engaged with the body 12 and each end 18 of each diagonally positioned biasing band 16.

As noted, the connections of the ends 18 of the biasing bands 16 and the reinforcing sections 20 to the body 12 can be by sewing with thread or could be by adhesive or sonic welding or other conventional means for attachment employed in the textile industry. Also as noted, it is particularly preferred to maximize the effectiveness of both the downward force "D" and sideways force "S", to position the opposing ends 18 of the biasing bands, 16 at locations on the side edge portions 14 of the body 12 which are immediately adjacent the perimeter edge 23 of the mattress 24 for which it is adapted to engage. This positioning, in experimentation, was shown to be superior in maintaining the sheet body 12 engaged.

Figure 7:
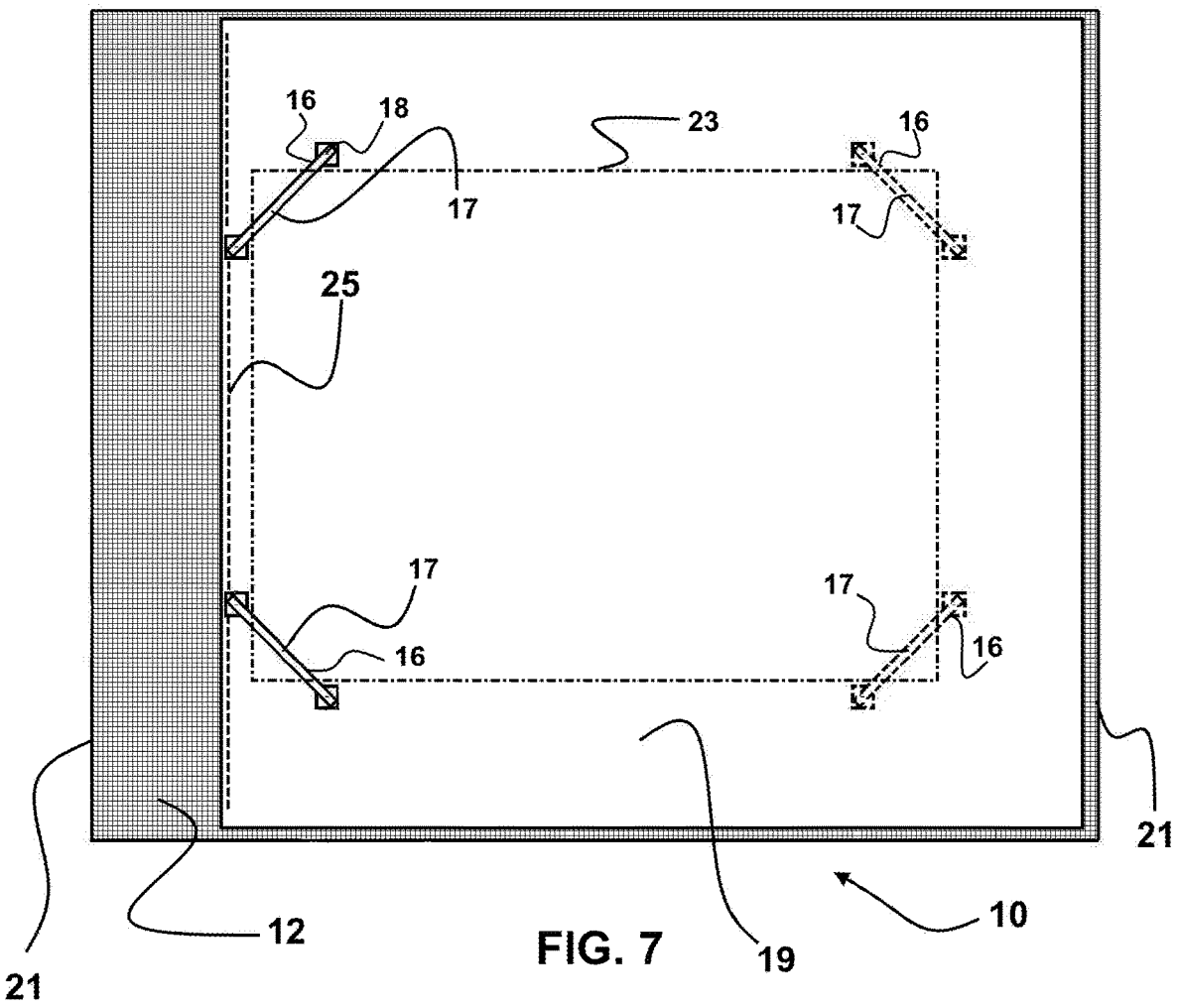
FIG. 7 depicts a mode of the device configured with a top bed sheet engaged with the bottom bed sheet, in a mode of the device allowing engagement of both bed sheets using the operatively positioned biasing bands.

FIG. 7 depicts a mode of the device 10 configured with a top bed sheet 19 engaged with the bottom bed sheet body 12 in a fixed engagement such as by stitching 25. The preferred mode of the device 10 allow for concurrent engagement of both the body 12 of the bottom sheet and the top sheet 19, concurrently, using the operatively positioned biasing bands 16. In this mode, where both the top sheet 19 and body 12 of the bottom sheet are rectangular, the biasing bands 16 for engagement with the mattress 24 at the foot end thereof, are positioned on the top sheet 19. The biasing bands 16 for engagement at the head-end of the mattress 24 are positioned on the body 12 of the bottom sheet.

Figure 8:
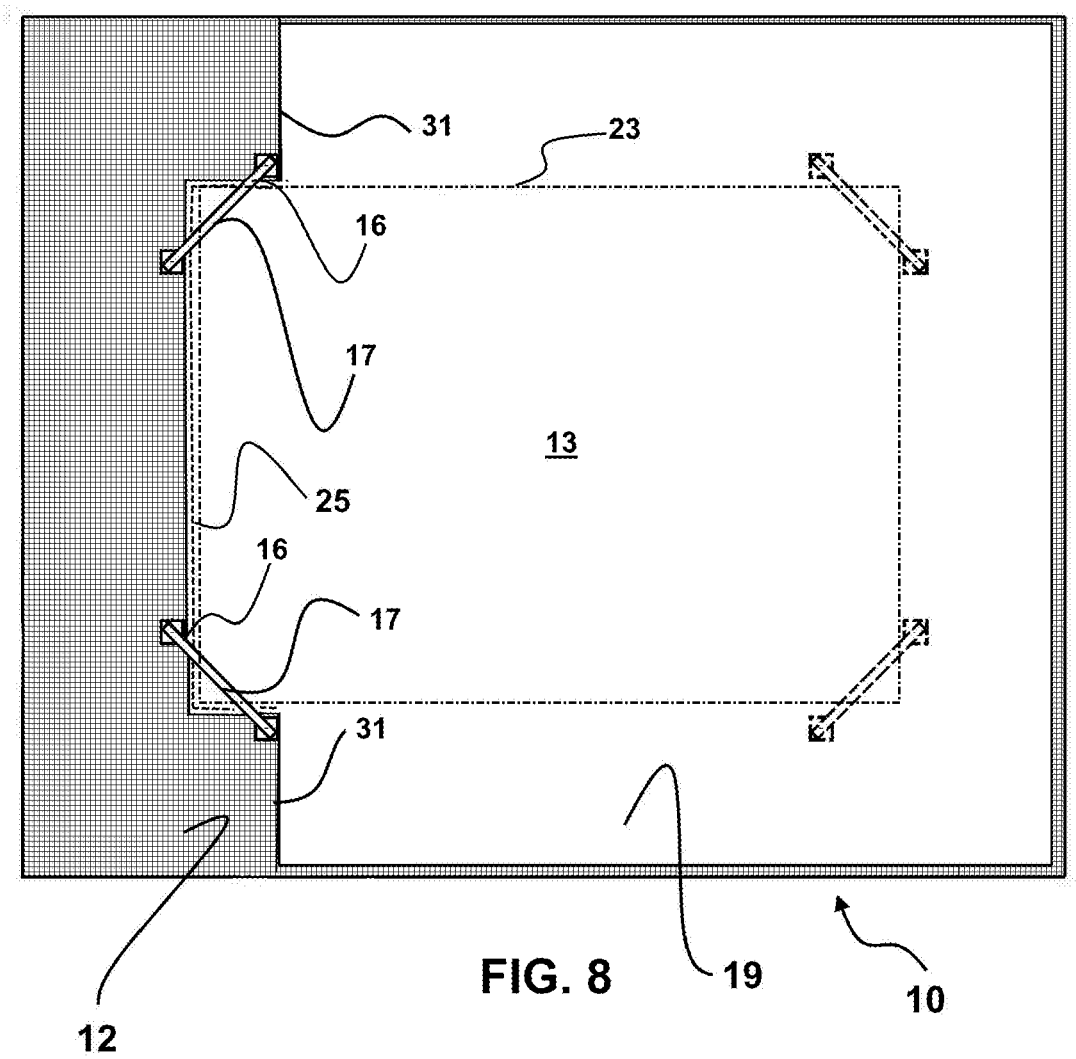
FIG. 8 shows a mode of the device similar to that of FIG. 7, which was found in experimentation to more easily and compactly fold for storage and also provide a top sheet which will not become disengaged.

The fixed engagement, as can be seen in FIGS. 7 and 8, shown as stitching 25, runs along a line of the stitching 25 positioned running between the edge portion positioned at the foot end which is located to contact said sidewall of said mattress at said foot end, and the engagement of two ends 18 of the biasing bands 16 to the body 12 which are positioned at the foot end. These two biasing bands 16, so located, are adapted to engage opposing corners of the mattress with a contact against said bottom surface thereof, at respective opposing corners of the underlying mattress at the foot end of said mattress.

Shown in FIG. 8, is a combination mode of the device 10 having both a bottom sheet and a top sheet 19 in a permanent connection such as by stitching 25 adjacent to area of the device 10 to be engaged to the foot end of the mattress 24. As shown, notches 31 are formed in the top sheet 19 which is connected along this notched edge with stitching 25 to the body 12 of the bottom sheet. In addition to reducing the bulk of the combination device 10 allowing for easier folding, the positioning of the open areas in the notches 31 at the two corners of the top sheet at the foot end of the bed, allow for locating the biasing bands 16 at the foot end of the mattress 24, upon the body 12 of the bottom sheet.

Figure 9:
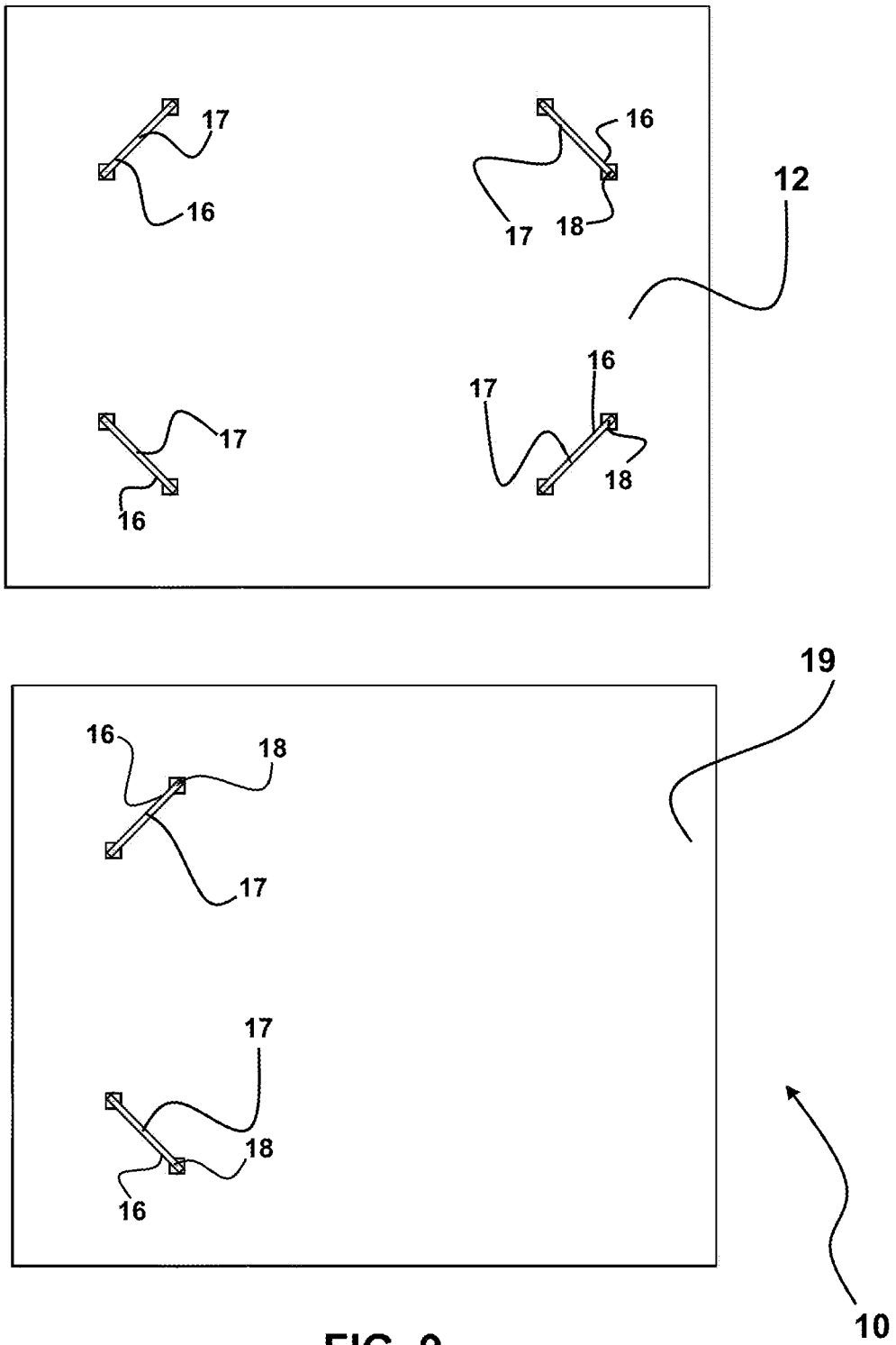
FIG. 9 shows both a top sheet having two diagonal biasing bands and bottom sheet with four biasing bands which allow for concurrent but separate mattress engagement with both sheets operatively positioned upon the intended mattress.

Finally, FIG. 9 shows a mode of the device 10 with both a top sheet 19 and bottom sheet having a body 12, which are provided in separate components. In this mode the body 12 forming the bottom sheet is configured and engaged with the intended mattress 24 as noted above. The top sheet 19 may be engaged over a mattress using the diagonally positioned biasing bands 16 with the foot end of the mattress 24, separately.

As noted, any of the different configurations and components can be employed with any other configuration or component shown and described herein. Additionally, while the present invention has been described herein with reference to particular embodiments thereof and steps in the method of use, a latitude of modifications, various changes and substitutions are intended in the foregoing disclosures, it will be appreciated that in some instance some features, or configurations, or steps could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A sheet apparatus comprising:

a bottom sheet, said bottom sheet adapted to engage upon a mattress where said mattress has a top surface surrounded by a sidewall where said sidewall extends a sidewall distance to a bottom surface of said mattress;

said bottom sheet having a body, said body having a body area which is planar, said planar body area extending to a perimeter edge of said body;

said bottom sheet having a bottom surface positionable upon said top surface of said mattress, and having a top surface opposite thereto;

said bottom sheet having four corners at said perimeter edge of said body which are not sewn to pockets;

said body having a rectangular central area with four corners thereof;

edge portions of said body, said edge portions extending for an edge width from a perimeter edge of said central area, to said perimeter edge of said body;

four biasing bands, each of said biasing bands having a central portion, said central portion extending between two opposing ends which are secured upon top surface of said body at securement positions adjacent said perimeter edge of said central area;

each of said four corners of said rectangular central area having one respective central portion of a respective said biasing band, extending thereover; and each respective central portion of each biasing band stretchable to a respective biased engagement at a respective corner of said mattress, said biased engagement positioning said central portion of said biasing band in a removable biased contact against said top surface of said sheet thereby holding said bottom surface of said sheet in biased contact with both said sidewall and said bottom surface of said mattress.

2. The sheet apparatus of claim 1, further comprising:

said rectangular central area of said body having a length and width;

said length and width of said central area being substantially equal to a length and width of said top surface of said mattress to which said bottom sheet is adapted to engage; and a positioning of said rectangular area upon said top surface of said mattress, with each of four corners of said mattress positioned under a respective central portion of one of said biasing bands, providing a targeting for said body to a proper positioning of said bottom sheet upon said mattress to which said bottom sheet is adapted to engage.

3. The sheet apparatus of claim 2, further comprising:

each respective said edge portion having a said edge width which exceeds said sidewall distance of said mattress to which said bottom sheet is adapted to engage, whereby distal ends of said edge portions positionable to a tucked engagement contacting said bottom surface of said mattress to which said bottom sheet is adapted to engage.

4. The sheet apparatus of claim 3, further comprising:

said biasing band while in said removable contact against said bottom surface of said mattress imparting a downward biasing force to said body which pulls said central area toward said sidewall of said mattress to which said bottom sheet is adapted to engage; and said biasing band while in said removable contact against said bottom surface of said mattress imparting a sideways biasing force to said body, said sideways force pulling opposing ends of each of said edge portions of said body, toward a respective corner of said mattress to which said bottom sheet is adapted to engage.

5. The sheet apparatus of claim 4, further comprising:

said bottom sheet having a foot end adapted for engagement to said mattress, at a foot end of said mattress; and a top sheet, one end of said top sheet in a fixed engagement of a foot end of said top sheet, to said body of said bottom sheet, said fixed engagement running along a line running between a said edge portion positioned to contact said sidewall of said mattress at said foot end thereof, and the engagement of said ends of two of said biasing bands to said body which are positioned for said contact against said bottom surface of said mattress, at respective opposing corners of said mattress, which are located at said foot end of said mattress.

6. The sheet apparatus of claim 5, further comprising:

notches formed into opposing corners of said top sheet at said foot end of said top sheet; and said fixed engagement of a foot end of said top sheet, to said body of said bottom sheet extending only in-between said notches.

7. The sheet apparatus of claim 2, further comprising:

said biasing band while in said removable contact against said bottom surface of said mattress imparting a downward biasing force to said body which pulls said central area toward said sidewall of said mattress to which said bottom sheet is adapted to engage; and said biasing band while in said removable contact against said bottom surface of said mattress imparting a sideways biasing force to said body, said sideways force pulling opposing ends of each of said edge portions of said body, toward a respective corner of said mattress to which said bottom sheet is adapted to engage.

8. The sheet apparatus of claim 7, further comprising:

said bottom sheet having a foot end adapted for engagement to said mattress, at a foot end of said mattress; and a top sheet, one end of said top sheet in a fixed engagement of a foot end of said top sheet, to said body of said bottom sheet, said fixed engagement running along a line running between a said edge portion positioned to contact said sidewall of said mattress at said foot end thereof, and the engagement of said ends of two of said biasing bands to said body which are positioned for said contact against said bottom surface of said mattress, at respective opposing corners of said mattress, which are located at said foot end of said mattress.

9. The sheet apparatus of claim 8, further comprising:

notches formed into opposing corners of said top sheet at said foot end of said top sheet; and said fixed engagement of a foot end of said top sheet, to said body of said bottom sheet extending only in-between said notches.

10. The sheet apparatus of claim 2, further comprising:

said bottom sheet having a foot end adapted for engagement to said mattress, at a foot end of said mattress; and a top sheet, one end of said top sheet in a fixed engagement of a foot end of said top sheet, to said body of said bottom sheet, said fixed engagement running along a line running between a said edge portion positioned to contact said sidewall of said mattress at said foot end thereof, and the engagement of said ends of two of said biasing bands to said body which are positioned for said contact against said bottom surface of said mattress, at respective opposing corners of said mattress, which are located at said foot end of said mattress.

11. The sheet apparatus of claim 1, further comprising:

each respective said edge portion having a said edge width which exceeds said sidewall distance of said mattress to which said bottom sheet is adapted to engage, whereby distal ends of said edge portions positionable to a tucked engagement contacting said bottom surface of said mattress to which said bottom sheet is adapted to engage.

12. The sheet apparatus of claim 11, further comprising:

said biasing band while in said removable contact against said bottom surface of said mattress imparting a downward biasing force to said body which pulls said central area toward said sidewall of said mattress to which said bottom sheet is adapted to engage; and said biasing band while in said removable contact against said bottom surface of said mattress imparting a sideways biasing force to said body, said sideways force pulling opposing ends of each of said edge portions of said body, toward a respective corner of said mattress to which said bottom sheet is adapted to engage.

13. The sheet apparatus of claim 11, further comprising:

said bottom sheet having a foot end adapted for engagement to said mattress, at a foot end of said mattress; and a top sheet, one end of said top sheet in a fixed engagement of a foot end of said top sheet, to said body of said bottom sheet, said fixed engagement running along a line running between a said edge portion positioned to contact said sidewall of said mattress at said foot end thereof, and the engagement of said ends of two of said biasing bands to said body which are positioned for said contact against said bottom surface of said mattress, at respective opposing corners of said mattress, which are located at said foot end of said mattress.

14. The sheet apparatus of claim 13, further comprising:

notches formed into opposing corners of said top sheet at said foot end of said top sheet; and said fixed engagement of a foot end of said top sheet, to said body of said bottom sheet extending only in-between said notches.

15. The sheet apparatus of claim 1, further comprising:

said biasing band while in said removable contact against said bottom surface of said mattress imparting a downward biasing force to said body which pulls said central area toward said sidewall of said mattress to which said bottom sheet is adapted to engage; and said biasing band while in said removable contact against said bottom surface of said mattress imparting a sideways biasing force to said body, said sideways force pulling opposing ends of each of said edge portions of said body, toward a respective corner of said mattress to which said bottom sheet is adapted to engage.

16. The sheet apparatus of claim 15, further comprising:

said bottom sheet having a foot end adapted for engagement to said mattress, at a foot end of said mattress; and a top sheet, one end of said top sheet in a fixed engagement of a foot end of said top sheet, to said body of said bottom sheet, said fixed engagement running along a line running between a said edge portion positioned to contact said sidewall of said mattress at said foot end thereof, and the engagement of said ends of two of said biasing bands to said body which are positioned for said contact against said bottom surface of said mattress, at respective opposing corners of said mattress, which are located at said foot end of said mattress.

17. The sheet apparatus of claim 16, further comprising:

notches formed into opposing corners of said top sheet at said foot end of said top sheet; and said fixed engagement of a foot end of said top sheet, to said body of said bottom sheet extending only in-between said notches.

18. The sheet apparatus of claim 1, further comprising:

said bottom sheet having a foot end adapted for engagement to said mattress, at a foot end of said mattress; and a top sheet, one end of said top sheet in a fixed engagement of a foot end of said top sheet, to said body of said bottom sheet, said fixed engagement running along a line running between a said edge portion positioned to contact said sidewall of said mattress at said foot end thereof, and the engagement of said ends of two of said biasing bands to said body which are positioned for said contact against said bottom surface of said mattress, at respective opposing corners of said mattress, which are located at said foot end of said mattress.

19. The sheet apparatus of claim 18, further comprising:

notches formed into opposing corners of said top sheet at said foot end of said top sheet; and said fixed engagement of a foot end of said top sheet, to said body of said bottom sheet extending only in-between said notches.

* * * * *